US011002051B2

(12) United States Patent
Ji et al.

(10) Patent No.: US 11,002,051 B2
(45) Date of Patent: May 11, 2021

(54) SPACE-SAVING MOVABLE DOOR/WINDOW SYSTEM CAPABLE OF BEING FULLY OPENED

(71) Applicants: JIANGSU VOCATIONAL INSTITUTE OF ARCHITECTURAL TECHNOLOGY, Jiangsu (CN); CHINA UNIVERSITY OF MINING AND TECHNOLOGY, Jiangsu (CN)

(72) Inventors: Xiang Ji, Xuzhou (CN); Hong Zhang, Xuzhou (CN); Yuan Ji, Xuzhou (CN); Xiangfeng Li, Xuzhou (CN); Bingke Xiao, Xuzhou (CN); Guohua Tian, Xuzhou (CN); Wei Liu, Xuzhou (CN); Dong Wang, Xuzhou (CN); Zhidong Chen, Xuzhou (CN); Yaxi Gong, Xuzhou (CN); Xinyu Liu, Xuzhou (CN)

(73) Assignees: JIANGSU VOCATIONAL INSTITUTE OF ARCHITECTURAL TECHNOLOGY, Xuzhou (CN); CHINA UNIVERSITY OF MINING AND TECHNOLOGY, Xuzhou (CN)

( * ) Notice: Subject to any disclaimer, the term of this patent is extended or adjusted under 35 U.S.C. 154(b) by 0 days.

(21) Appl. No.: 16/478,855

(22) PCT Filed: Jan. 6, 2018

(86) PCT No.: PCT/CN2018/071687
§ 371 (c)(1),
(2) Date: Jul. 18, 2019

(87) PCT Pub. No.: WO2018/227955
PCT Pub. Date: Dec. 20, 2018

(65) Prior Publication Data

US 2019/0376330 A1 Dec. 12, 2019

(30) Foreign Application Priority Data

Jun. 16, 2017 (CN) ..... 201710454190.8

(51) Int. Cl.
*E05D 15/06* (2006.01)
*E05F 15/60* (2015.01)
(Continued)

(52) U.S. Cl.
CPC ..... *E05D 15/0604* (2013.01); *E05D 15/58* (2013.01); *E05F 15/60* (2015.01);
(Continued)

(58) Field of Classification Search
CPC ..... E05D 15/0604; E05D 15/0647; E05D 15/0682; E05D 15/48; E05D 2015/485; E06B 3/5054; E06B 3/5072; E06B 3/4645
(Continued)

(56) References Cited

U.S. PATENT DOCUMENTS 2,657,436 A * 11/1953 Fairhurst ..... E04B 2/827 52/64
2,792,596 A * 5/1957 Jensen ..... E06B 3/924 49/127
(Continued)

FOREIGN PATENT DOCUMENTS

CN 201273110 Y 7/2009
CN 201874403 U 6/2011
(Continued)

*Primary Examiner* — Gregory J Strimbu
(74) *Attorney, Agent, or Firm* — Bayramoglu Law Offices LLC

(57) ABSTRACT

A space-saving lengthwise and widthwise movable panel system capable of being fully opened belongs to the field of smart building technology and includes a lengthwise panel moving compartment, a panel storage space and a panel control module. The movable panel system can be used as a
(Continued)

door and/or window system. All of the panels of the system can be entirely stored in the panel storage space and when storing all of the panels entirely in the panel storage space, the panel system is fully open to allow full lengthwise access to a space. The panel storage space may be located in a wall or outside the room to hide the stacked panels. By controlling the operation of the moving system, the panels are effectively connected to one another in an aligned manner and can move automatically, so the space-saving movable panel system is convenient to use, and space-saving.

6 Claims, 16 Drawing Sheets

(51) Int. Cl.
*E05D 15/58* (2006.01)
*E06B 3/50* (2006.01)

(52) U.S. Cl.
CPC ..... *E06B 3/5054* (2013.01); *E05Y 2900/132* (2013.01); *E05Y 2900/148* (2013.01)

(58) Field of Classification Search
USPC ..... 49/127, 128, 130
See application file for complete search history.

(56) References Cited

U.S. PATENT DOCUMENTS

| | | | | |
|---|---|---|---|---|
| 3,142,096 | A * | 7/1964 | Von Munchhausen | E04B 2/827 49/127 |
| 3,425,160 | A * | 2/1969 | Petterborg | E05F 15/646 49/127 |
| 3,577,679 | A * | 5/1971 | Petterborg | E05F 15/638 49/127 |
| 6,082,053 | A * | 7/2000 | Bischof | E05D 15/0604 49/221 |
| 6,233,878 | B1 * | 5/2001 | Krahenbuhl | E05F 15/632 52/64 |
| 7,270,165 | B1 * | 9/2007 | Chuang | E05D 15/0647 160/197 |
| 2007/0271850 | A1 * | 11/2007 | Mickelson | E05D 15/565 49/358 |

FOREIGN PATENT DOCUMENTS

| | | | |
|---|---|---|---|
| CN | 105804594 | A | 7/2016 |
| CN | 107083904 | A | 8/2017 |
| JP | 2016113859 | A | 6/2016 |

* cited by examiner

SPACE-SAVING MOVABLE DOOR/WINDOW SYSTEM CAPABLE OF BEING FULLY OPENED

CROSS-REFERENCE TO RELATED APPLICATIONS

This application is the national phase entry of International Application PCT/CN2018/071687, filed on Jan. 6, 2018 which is based upon and claims priority to Chinese Patent Application No. 201710454190.8, filed on Jun. 16, 2017 the entire contents of which are incorporated herein by reference.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable

STATEMENT REGARDING PRIOR DISCLOSURES BY THE INVENTOR OR A JOINT INVENTOR

Not Applicable

BACKGROUND OF THE INVENTION

In the existing buildings, the doors/windows, such as French windows and the like, are usually opened or closed by rotating or sliding, not allowing to completely and freely open the doors/windows in the space. It is hard to avoid the pivoting shaft if the mode of opening and closing the windows/doors by rotating is chosen, and the opened size of the windows/doors tends to waste space. The sliding windows/doors also cannot achieve full opening of the window as one or two pieces of door/window panel are fixed, limiting the utilization of buildings' space, and having difficulty in satisfying the further requirements of fully utilizing the space.

(1) FIELD OF THE INVENTION

The present invention relates to a movable door/window system which belongs to the field of smart building technology.

(2) DESCRIPTION OF RELATED ART

Not Applicable

BRIEF SUMMARY OF THE INVENTION

To overcome drawbacks of the prior art, the present invention provides a space-saving movable door/window system capable of being fully opened, which can be fully opened, further save the space, can be intelligently controlled, and is convenient to use.

The present invention is implemented by the following technical solutions: a space-saving movable door/window system capable of being fully opened includes a door/window panel mounting space, a door/window panel storage space, and a door/window panel control module.

The door/window panel mounting space includes an upper track groove located in a top board and a lower track groove located below a ground surface. The upper track groove and the lower track groove extend in a same direction and are parallel to each other. A plurality of door/window panels are successively arranged and provided between the upper track groove and the lower track groove. The door/window panel storage space is located at an end of the door/window panel mounting space. The door/window panel storage space includes a door/window panel stacking space located between the top board and the ground, an upper widthwise moving space located in the top board, a lower widthwise moving space located below the ground surface. A length of the door/window panel stacking space is equal to a length of each door/window panel, and a width of the door/window stacking space is a sum of thicknesses of all the door/window panels in a same row.

The door/window panel includes a door/window panel main body, a door/window panel top frame located at an upper side of the door/window panel main body, and a door/window panel base located at a lower side of the door/window panel main body. An upper lengthwise moving track is provided in the upper track groove. An upper part of the door/window top frame is provided with upper lengthwise moving guide wheels matching with the upper lengthwise moving track. A lower lengthwise moving track is provided in the lower track groove. A lower part of the door/window base is provided with lower lengthwise moving wheels matching with the lower lengthwise moving track. The lower lengthwise moving wheels of each door/window panel are provided with at least one lengthwise moving power wheel. The lengthwise moving power wheel is driven by a lengthwise moving motor of each door/window panel. An upper widthwise moving track is provided in the upper widthwise moving space. The upper widthwise moving track is perpendicular to the upper lengthwise moving track. The upper widthwise moving track is provided with an upper track frame capable of sliding widthwise along the upper widthwise moving track. The upper track frame is placed on the upper widthwise moving track through an upper widthwise moving power wheel. The upper widthwise moving power wheel is driven by an upper widthwise moving motor. A lower part of the upper widthwise moving space is provided with an upper moving groove at a position corresponding to the door/window stacking space. An interior of the upper widthwise moving space is provided with an upper track frame storage cavity at a position opposite to the upper moving groove. A lower part of the upper track frame is provided with a plurality of upper butting tracks matching with the door/window. The upper butting tracks serve as an extension of the upper lengthwise moving track in a lengthwise direction. When one of the upper butting tracks is butted to the upper lengthwise moving track, the rest of the upper butting tracks are misaligned with the upper lengthwise moving track, and the upper lengthwise moving guide wheel of the upper part of each door/window panel can enter the corresponding upper butting track after the upper butting track is butted with the upper lengthwise moving track.

A lower widthwise moving track is provided in the lower widthwise moving space. The lower widthwise moving track is perpendicular to the lower lengthwise moving track. The lower widthwise moving track is provided with a lower track frame capable of sliding widthwise along the lower widthwise moving track. The lower track frame is placed on the lower widthwise moving track through a lower widthwise power wheel. The lower widthwise power wheel is driven by a lower widthwise moving motor. An upper part of the lower widthwise moving space is provided with a lower moving groove at a position corresponding to the door/window stacking space. An interior of the lower widthwise moving space is provided with a lower track frame storage cavity at a position opposite to the lower moving groove. An upper part of the lower track frame is provided with a plurality of lower butting tracks matching with the door/window panels. The lower butting tracks serve as an extension of the lower lengthwise moving track. When one of the lower butting tracks is butted to the lower lengthwise moving track, the rest of the lower butting tracks are misaligned with the lower lengthwise moving track. The lower lengthwise moving wheel at the lower part of each door/window panel can enter the corresponding lower butting track after the lower butting track is butted with the lower lengthwise moving track.

The door/window panel control module includes a main control unit, a main control switch, a communication module, an inductive switch, a driving unit, and an executive unit. The main control switch is connected to the main control unit through the communication module. The main control unit drives the executive unit through the driving unit. The executive unit includes the widthwise moving motor and the lengthwise moving motor. The upper and lower widthwise moving motors acting synchronously are regarded as a whole to form the widthwise moving motor. The inductive switch is connected to the main control unit.

When the main control switch activates an instruction of opening, the main control switch sends a signal to the main control unit through the communication module. The main control unit drives the lengthwise moving motor to act through the driving unit and controls the door/window panels to move toward the door/window panel storage space. When the inductive switch detects that the door/window panel completely enters the corresponding upper and lower butting tracks, the inductive switch sends a signal to the main control unit. The main control unit drives the widthwise moving motor to act through the driving unit and controls the upper and lower track frames to move widthwise toward the door/window panel storage by one position, so that the next upper and lower butting tracks are able to butt with the upper and lower lengthwise moving tracks. By repeating the above processes, each door/window panel is controlled to move into the predetermined track, and the door/window panels are stack together in the door/window panel stacking space.

When the main control switch activates an instruction of closing, the main control switch sends a signal to the main control unit through the communication module. The main control unit drives the lengthwise moving motor to act through the driving unit and controls the door/window panels to move toward the door/window panel mounting space. When the inductive switch detects that the door/window panel completely leaves the corresponding upper and lower butting tracks, the inductive switch sends a signal to the main control unit. The main control unit drives the widthwise moving motor to act by the driving unit and controls the upper and lower track frames to move widthwise toward the upper and lower track frame storage cavity by one position, so that the next upper, lower butting tracks are able to butt with the upper and lower lengthwise moving tracks. By repeating the above processes, each door/window panel is controlled to enter the upper and lower lengthwise moving tracks and the door/window panels can extend in the door/window panel mounting space to close the space.

An end of each door/window panel main body is hinged to the door/window panel top frame and the door/window panel base through a single panel rotating shaft. The other end of each door/window panel main body is locked on the door/window panel base through a single panel hand-actuated bolt.

The end of each door/window panel main body near the single panel hand-actuated bolt is provided with an inwardly recessed arc-shaped groove to provide a rotating space for the adjacent door/window panel main body.

Each door/window panel is provided with a chargeable power supply to supply power to the lengthwise moving motor. Conductor interfaces of a positive electrode wire and a negative electrode wire of the chargeable power supply are connected to conductor interfaces of other door/window panels to form a parallel charging circuit. A wall body is provided with an alternating current charging connector. The conductor interface of the door/window panel near the wall body is connected to the alternating current charging connector to form a charging circuit.

The upper widthwise moving motor and the lower widthwise moving motor are connected to a wired power source.

The communication module is a wired communication device.

The communication module is a wireless communication device.

The upper widthwise moving motor, the lengthwise moving motor, and the lower widthwise moving motor are respectively connected to a corresponding power wheel through a belt-driven wheel pair or a chain-driven wheel pair.

The present invention has the following advantages. The present invention adopts a lengthwise and widthwise moving system with the door/window panel storage space. All of the door/window panels can be entirely stored in the door/window panel storage space, making the door/window fully opened to spare all the occupied space. The door/window panel storage space may be located in a wall or outside the room to hide the stacked door/window panels. By controlling the operations of the moving system and the control system, the door/window panels are effectively connected to one another in an aligned manner and can move automatically, so the space-saving movable door/window system is convenient to use, space-saving, and can effectively improve space utilization ratio.

Additionally, the device allowing the rotation of a single door/window panel is provided to increase the opening modes of the door/window panels, making the use of the door/window and space more free and flexible. The inwardly recessed arc-shaped grooves are provided between the door/window panels to ensure that the door/window panels are leakproof after being butted to one another without affecting the rotation of a single door/window panel at the same time.

Additionally, a door/window charging system is provided. Charging may be realized after closing the door/window.

The present invention is worthy popularizing and using.

BRIEF DESCRIPTION OF THE SEVERAL VIEWS OF THE DRAWING(S)

The present invention will be further described hereinafter with reference to the drawings and embodiments.

Figure 1:
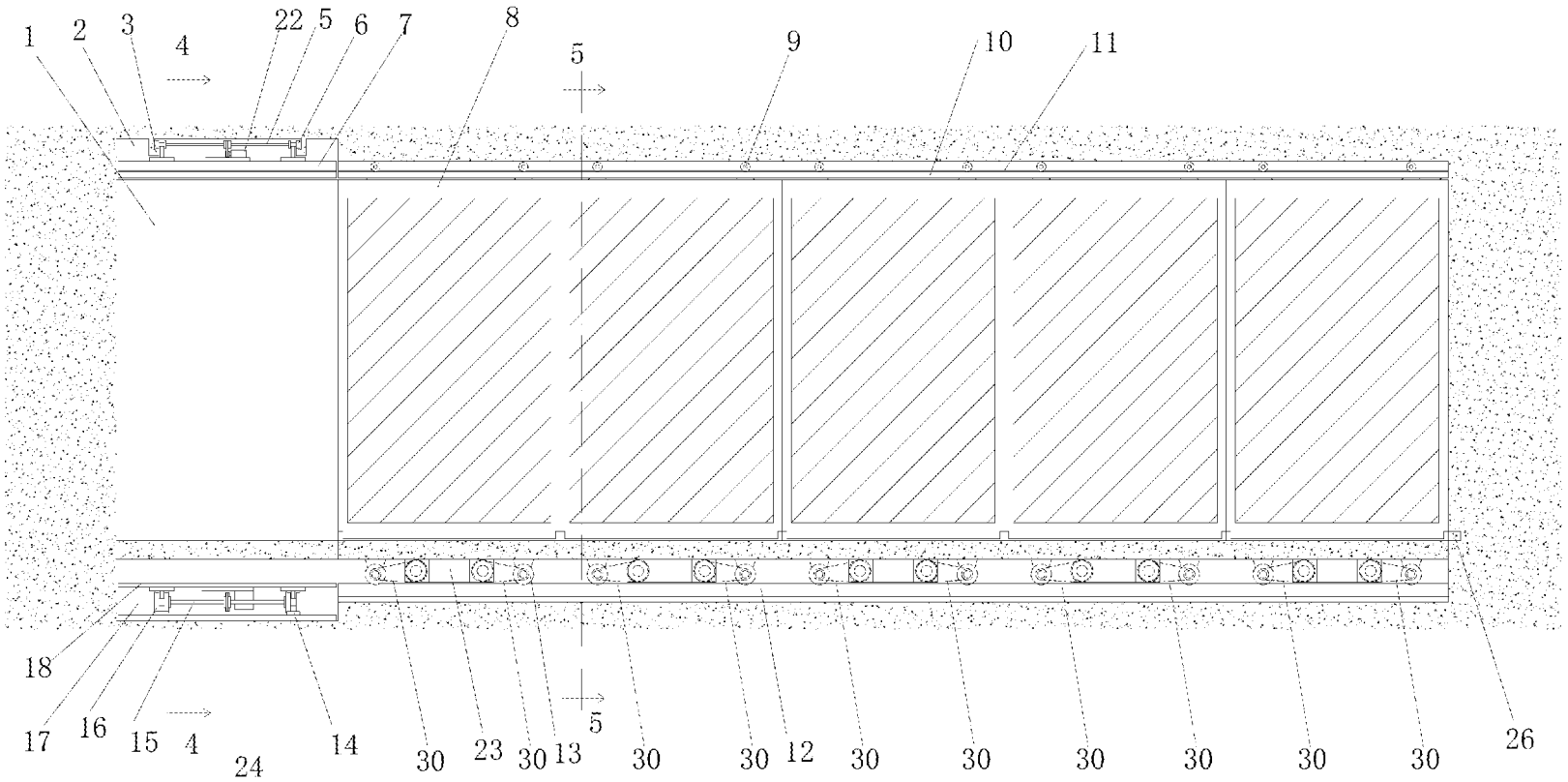
FIG. 1 is a structural schematic diagram of the present invention (please rotate the drawing clockwise by 90 degrees when reading)
Figure 2:
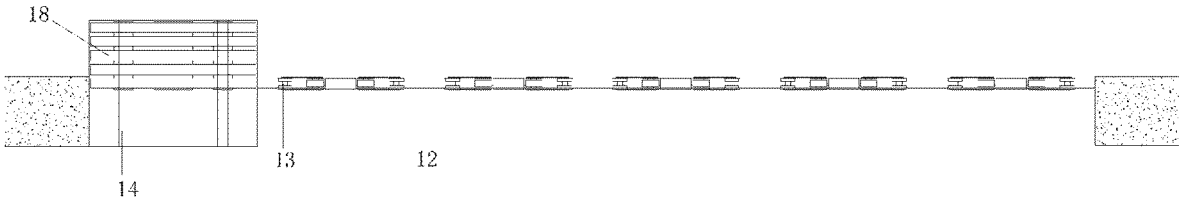
FIG. 2 is a bottom view of FIG. 1 (please rotate the drawing clockwise by 90 degrees when reading)
Figure 3:
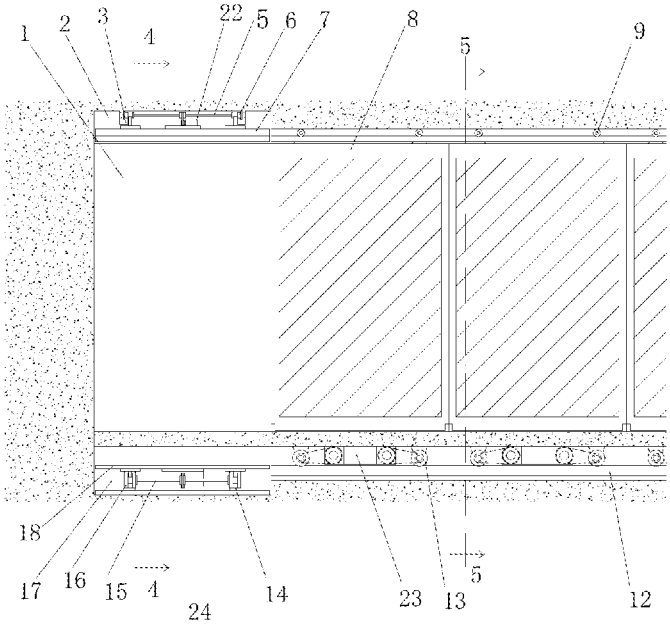
FIG. 3 is a partially enlarged diagram showing a door/window panel mounting space and a door/window panel storage space of the present invention.
Figure 5:
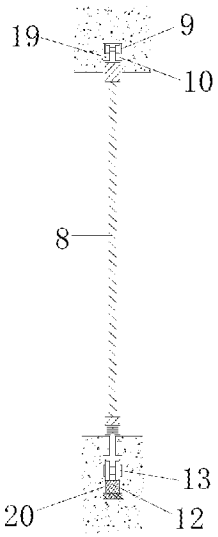
FIG. 5 is a sectional view of FIG. 1 taken on the line 5-5.
Figure 4:
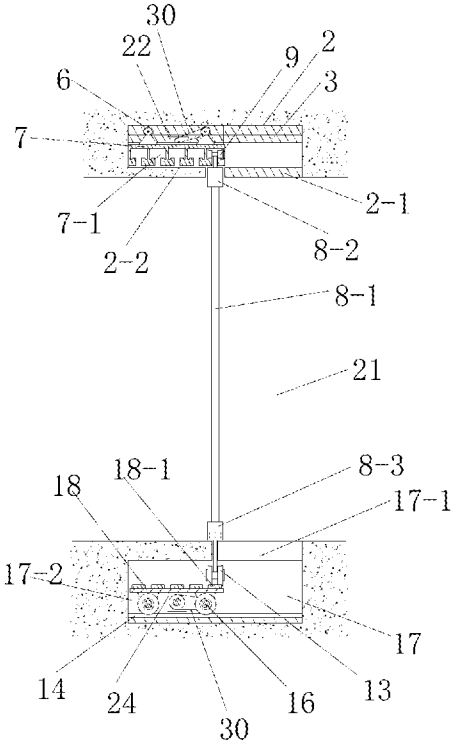
FIG. 4 is a sectional view of FIG. 1 taken on the line 4-4.
Figure 6:
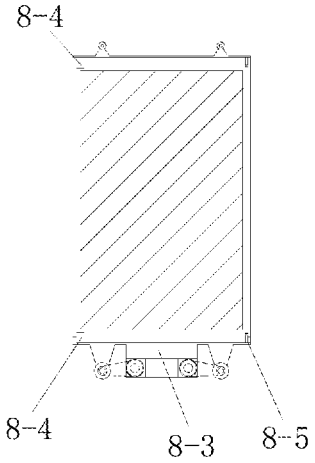
FIG. 6 is a structural schematic diagram of a single door/window panel.
Figure 7:
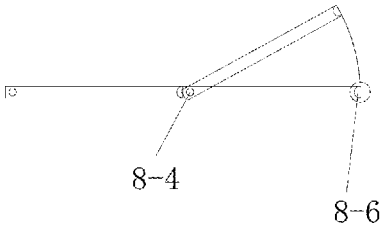
FIG. 7 is a schematic diagram showing that a single door/window panel is opened by rotating.
Figure 8:
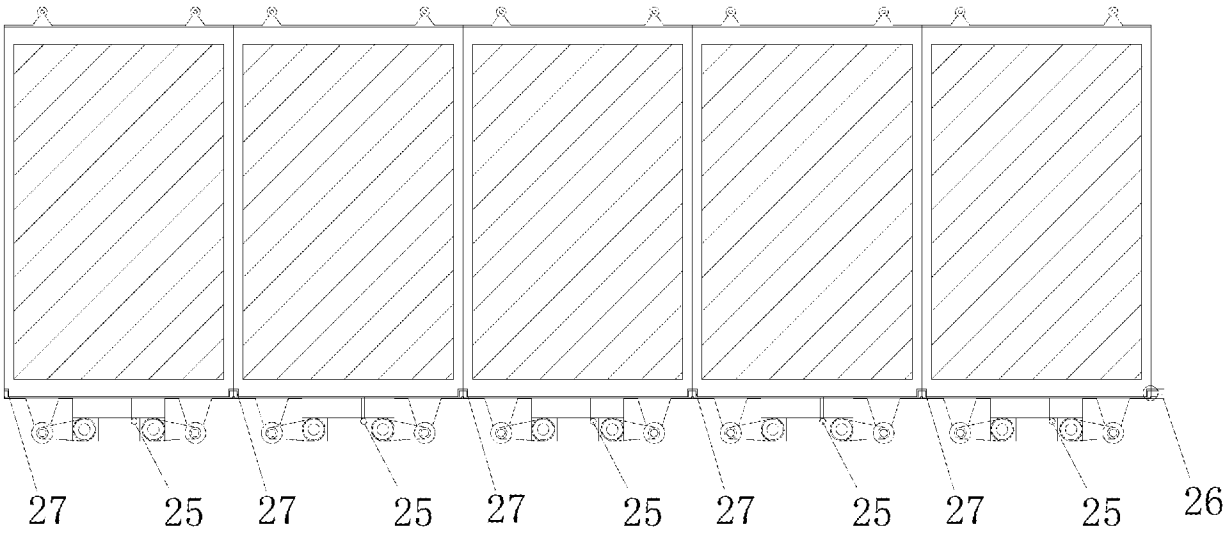
FIG. 8 is a schematic diagram showing the charging of a power supply of the present invention.
Figure 9:
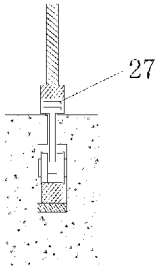
FIG. 9 is a left view of FIG. 8.
Figure 10:
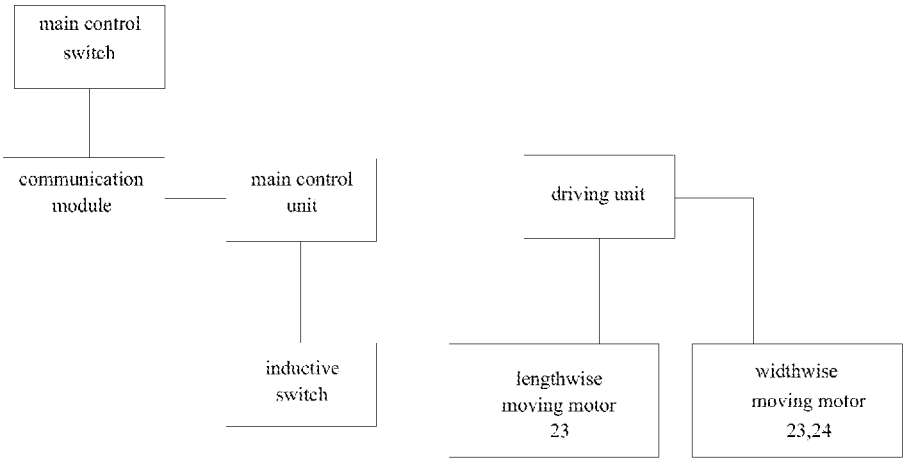
FIG. 10 is a control functional diagram of the present invention.

In the drawings: door/window panel storage space 1; upper widthwise moving space 2; upper widthwise moving track 3; upper butting track 4; upper axle 5; upper widthwise moving power wheel 6; upper track frame 7; door/window panel 8; upper lengthwise moving guide wheel 9; upper lengthwise moving track 10; door/window panel mounting space 11; lower lengthwise moving track 12; lower lengthwise moving wheel 13; lower widthwise moving track 14; lower axle 15; lower widthwise moving power wheel 16; lower widthwise moving space 17; lower track frame 18; upper track groove 19; lower track groove 20; door/window panel stacking space 21; upper widthwise moving motor 22; lengthwise moving motor 23; lower widthwise moving motor 24; chargeable power supply 25; alternating current charging connector 26; conductor interface 27.

DETAILED DESCRIPTION OF THE EMBODIMENTS

The present invention will be described hereinafter with reference to the embodiments.

As shown in FIG. 1-FIG. 10, a space-saving movable door/window system capable of being fully opened includes the door/window panel mounting space 11, the door/window panel storage space 1, and the door/window panel control module.

The door/window panel mounting space 11 includes the upper track groove 19 located in a top board and the lower track groove 20 located below a ground surface. The upper track groove and the lower track groove extend in the same direction and are parallel to each other. A plurality of successively arranged door/window panels 8 are provided between the upper track groove and the lower track groove. The door/window panel storage space 1 is located at an end of the door/window panel mounting space. The door/window panel storage space 1 includes the door/window panel stacking space 21 located between the top board and the ground, the upper widthwise moving space 2 located in the top board, the lower widthwise moving space 17 located below the ground surface. The length of the door/window panel stacking space 21 is equal to the length of each door/window panel 8, and the width of the door/window panel stacking space is a sum of thicknesses of all the door/window panels in the same row.

The door/window panel 8 includes the door/window panel main body 8-1, the door/window panel top frame 8-2 located at an upper side of the door/window panel main body and the door/window panel base 8-3 located at a lower side of the door/window panel main body. The upper lengthwise moving track 10 is provided in the upper track groove 19. An upper part of the door/window panel top frame 8-1 is provided with the upper lengthwise moving guide wheels 9 matching with the upper lengthwise moving track 10. The lower lengthwise moving track 12 is provided in the lower track groove 20. A lower part of the door/window panel base 8-3 is provided with the lower lengthwise moving wheels 13 matching with the lower lengthwise moving track 12. The lower lengthwise moving wheels 13 of each door/window panel is provided with at least one lengthwise moving power wheel. The lengthwise moving power wheel is driven by the lengthwise moving motor 23 of each door/window panel. The upper widthwise moving track 3 is provided in the upper widthwise moving space 2. The upper widthwise moving track 3 is perpendicular to the upper lengthwise moving track 10. The upper widthwise moving track is provided with the upper track frame 7 capable of sliding widthwise along the upper widthwise moving track. The upper track frame 7 is placed on the upper widthwise moving track through the upper widthwise moving power wheel 6. The upper widthwise moving power wheel is driven by the upper widthwise moving motor 22. The upper axle 5 is provided between the two upper widthwise moving power wheels 6. The upper widthwise moving motor 22 drives the upper axle 5 to rotate through a wheel pair. A lower part of the upper widthwise moving space 2 is provided with the upper moving groove 2-1 at a position corresponding to the door/window panel stacking space. An interior of the upper widthwise moving space 2 is provided with an upper track frame storage cavity 2-2 at a position opposite to the upper moving groove. A lower part of the upper track frame 7 is provided with a plurality of upper butting tracks 4 matching with the door/window panels. The upper butting tracks serve as an extension of the upper lengthwise moving track 10 in the lengthwise direction. When one of the upper butting tracks is butted to the upper lengthwise moving track, the rest of upper butting tracks are misaligned with the upper lengthwise moving track, and the upper lengthwise moving guide wheel 9 of the upper part of each door/window panel 8 can enter the corresponding upper butting track 4 after the upper butting track is butted with the upper lengthwise moving track.

The lower widthwise moving track 14 is provided in the lower widthwise moving space 17. The lower widthwise moving track is perpendicular to the lower lengthwise moving track 12. The lower widthwise moving track 14 is provided with the lower track frame 18 capable of sliding widthwise along the lower widthwise moving track 14. The lower track frame is placed on the lower widthwise moving track through the lower widthwise moving power wheels 16. The lower widthwise moving power wheels 16 are driven by the lower widthwise moving motor 24. The lower axle 15 is provided between the lower widthwise moving power wheels 16. The lower widthwise moving motor 24 first drives the lower axle 15 to rotate through the wheel pair. An upper part of the lower widthwise moving space 17 is provided with the lower moving groove 17-1 at a position corresponding to the door/window panel stacking space 21. An interior of the lower widthwise moving space is provided with a lower track frame storage cavity 17-2 at a position opposite to the lower moving groove 17-1. An upper part of the lower track frame 18 is provided with a plurality of lower butting tracks 18-1 matching with the door/window panels. The lower butting tracks serve as an extension of the lower lengthwise moving track 12 in the lengthwise direction. When one of lower butting tracks is butted to the lower lengthwise moving track, the rest of lower butting tracks are misaligned with the lower lengthwise moving track, and the lower lengthwise moving wheel 13 at the lower part of each door/window panel can enter the corresponding lower butting track after the lower butting track is butted with the lower lengthwise moving track. The present invention adopts a lengthwise and widthwise moving system with the door/window panel storage space. All of the door/window panels can be entirely stored in the door/window panel storage space, making the door/window fully opened to spare all the occupied space. The door/window panel storage space may be located in a wall or outside the room to hide the stacked door/window panels. By controlling the operations of the moving system and the control system, the door/window panels are effectively connected to one another in an aligned manner and can move automatically, so the space-saving movable door/window system is convenient to use, space-saving, and can effectively improve space utilization ratio.

The door/window panel control module includes a main control unit, a main control switch, a communication module, an inductive switch, a driving unit, and an executive unit. The main control switch is connected to the main control unit through the communication module. The main control unit drives the executive unit through the driving unit. The executive unit includes the widthwise moving motor and the lengthwise moving motor. The upper and lower widthwise moving motors acting synchronously are regarded as a whole to form the widthwise moving motor. The inductive switch is connected to the main control unit.

When the main control switch activates an instruction of opening, the main control switch sends a signal to the main control unit through the communication module. The main control unit drives the lengthwise moving motor to act through the driving unit and controls the door/window panels to move toward the door/window panel storage space. When the inductive switch detects that the door/window panel completely enters the corresponding upper and lower butting tracks, the inductive switch sends a signal to the main control unit. The main control unit drives the widthwise moving motor to act through the driving unit and controls the upper and lower track frames to move widthwise toward the door/window panel storage direction by one position, so that the next upper and lower butting tracks are able to but with the upper and lower lengthwise moving tracks. By repeating the above processes, each door/window panel is controlled to move into the predetermined track, and the door/window panels are stack together in the door/window panel stacking space.

When the main control switch activates an instruction of closing, the main control switch sends a signal to the main control unit through the communication module. The main control unit drives the lengthwise moving motor to act through the driving unit and controls the door/window panels to move toward the door/window panel mounting space. When the inductive switch detects that the door/window panel had completely left the corresponding upper and lower butting tracks, the inductive switch sends a signal to the main control unit. The main control unit drives the widthwise moving motor to act by the driving unit and controls the upper and lower track frames to move widthwise toward the upper and lower track frame storage cavity by one position, so that the next upper, lower butting tracks are able to butt with the upper and lower lengthwise moving tracks. By repeating the above processes, each door/window panel is controlled to enter the upper and lower lengthwise moving tracks and the door/window panels can extend in the door/window panel mounting space to close the space.

An end of each door/window panel main body 8-1 is hinged to the door/window panel top frame 8-2 and the door/window panel base 8-3 through the single panel rotating shaft 8-4. The other end of each door/window panel main body 8-1 is locked on the door/window panel base 8-3 through the single panel hand-actuated bolt 8-5. The hand-actuated bolt effectively fixes the door/window panels.

The end of each door/window panel main body 8-1 near the single panel hand-actuated bolt 8-5 is provided with the inwardly recessed arc-shaped groove 8-6 to provide a rotating space for the adjacent door/window panel main body 8-1. According to the present invention, the device allowing the rotation of a single door/window panel is provided to increase the opening modes of the door/window panels, making the use of the door/window and space more free and flexible. The inwardly recessed arc-shaped grooves are provided between the door/window panels to ensure that the door/window panels are leakproof after being butted to one another without affecting the rotation of a single door/window panel at the same time.

Each door/window panel 8 is provided with a chargeable power supply 25 to supply power to the lengthwise moving motor 23. Conductor interfaces 27 of a positive electrode wire and a negative electrode wire of the chargeable power supply 25 are connected to conductor interfaces 27 of other door/window panels 8 to form a parallel charging circuit. A wall body is provided with an alternating current charging connector 26. The conductor interface 27 of the door/window panel 8 near the wall body is connected to the alternating current charging connector 26 to form a charging circuit.

The upper widthwise moving motor 22 and the lower widthwise moving motor 24 are connected to a wired power source.

The communication module is a wired communication device.

The communication module is a wireless communication device, such as ZigBee wireless control or infrared ray control, etc.

The upper widthwise moving motor 22, the lengthwise moving motor 23 and the lower widthwise moving motor 24 are connected to the corresponding power wheels through a belt or chain 30.

The present invention has four use states.

Figure 11:
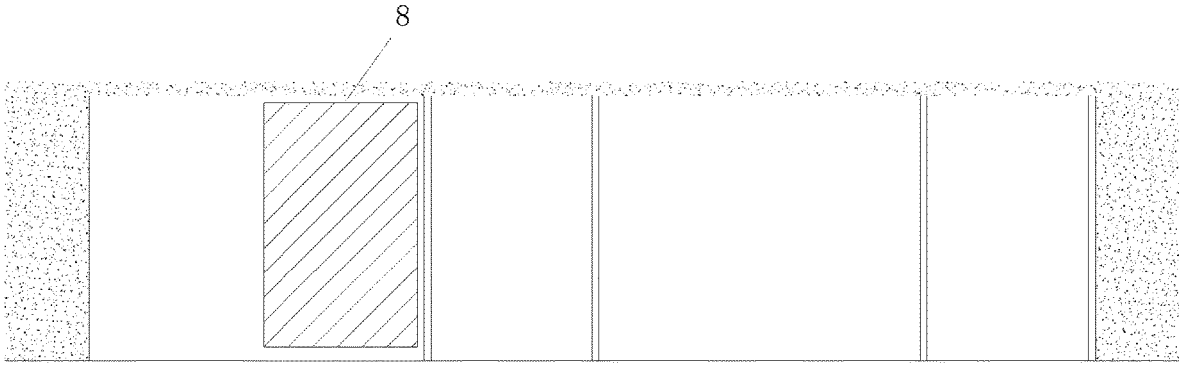
FIG. 11 is a schematic diagram showing the present invention in the first use state.

FIG. 11 shows a first use state of a normal door/window with multiple panels, where a single panel can be opened by rotating independently. When the door/window is closed, the hand-actuated bolt 8-5 can effectively fix the door/window panel.

Figure 12:
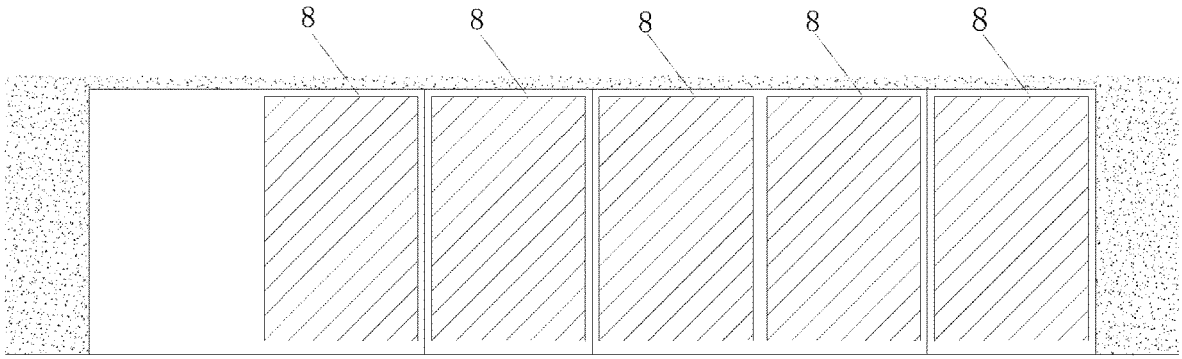
FIG. 12 is a schematic diagram showing the present invention in the second use state.

FIG. 12 shows a second use state when the door/window panels are all closed. The single panel rotating shaft at the bottom is locked by the hand-actuated bolt, thereby getting ready to be moved and stacked together.

Figure 13:
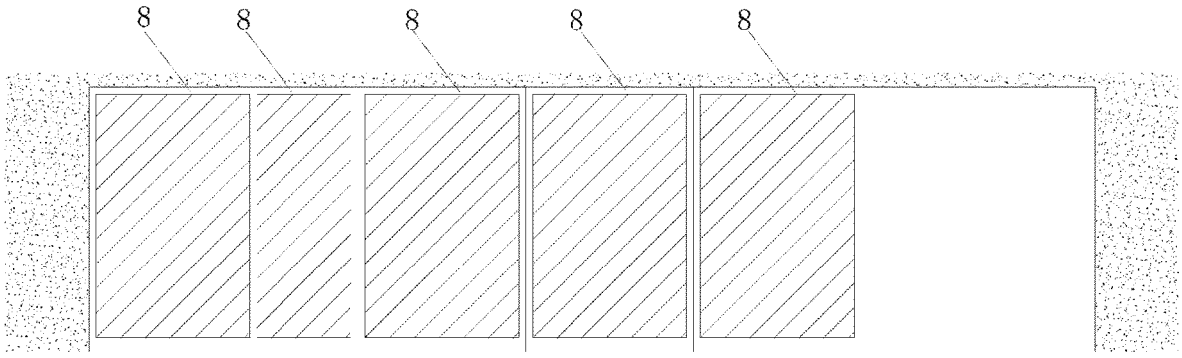
FIG. 13 is a schematic diagram showing the present invention in the third use state.

FIG. 13 shows a third use state. The door/window panels gradually move lengthwise in a same direction toward the door/window panel storage space. When the first door/window panel reaches a specific position, the door/window panel moves widthwise from bottom to spare a next empty track for the second door/window panel to move into.

Figure 14:
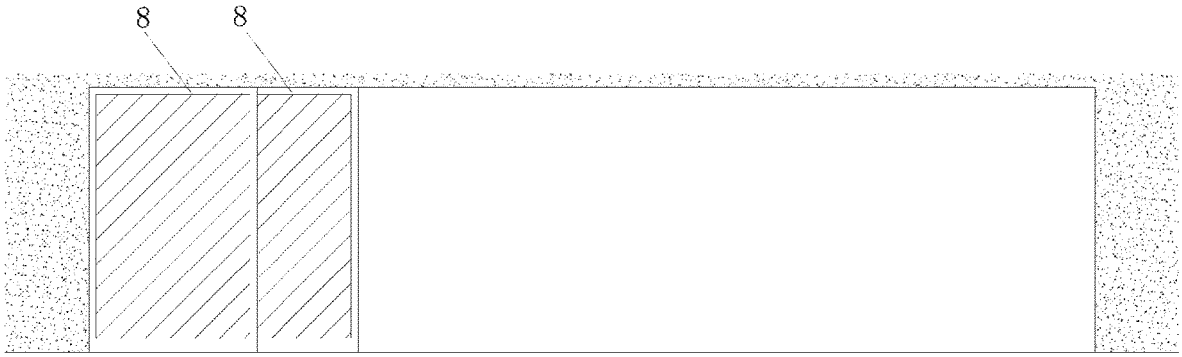
FIG. 14 is a schematic diagram showing the present invention in the fourth use state.
Figure 15:
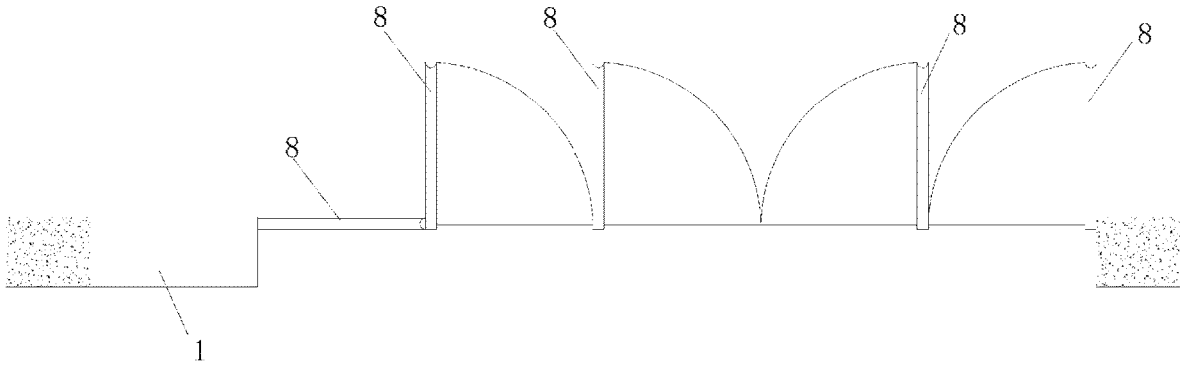
FIG. 15 is a top view of FIG. 11.
Figure 16:
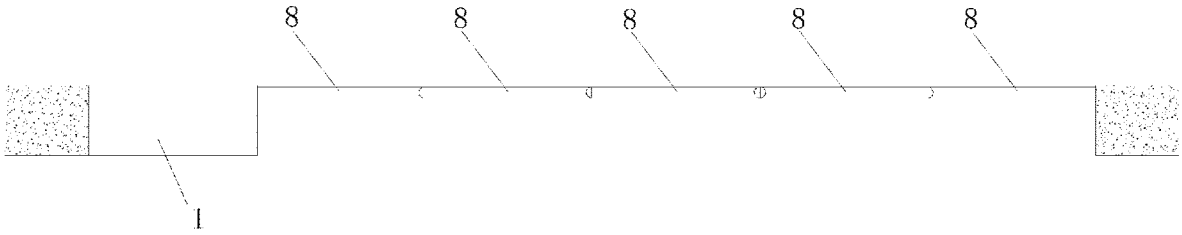
FIG. 16 is a top view of FIG. 12.
Figure 17:
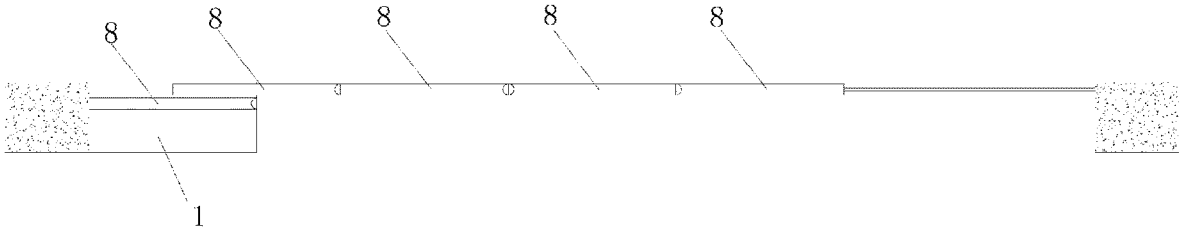
FIG. 17 is a top view of FIG. 13.
Figure 18:
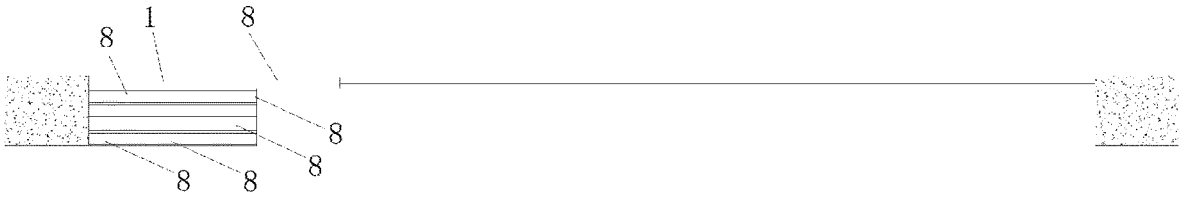
FIG. 18 is a top view of FIG. 14.

FIG. 14 shows a fourth use state. The door/window panels gradually move lengthwise in the same direction. When the first door/window panel reaches the specific position, the door/window panels move widthwise from the bottom to spare the empty track for the second door/window panel to move in till all door/window panels move into the track. A total storage volume is a sum of volumes of all door/window panels. All the door/window panels are stacked together in the door/window panel stacking space to save the storage space with the door/window in the space fully opened.

What is claimed is:

1. A space-saving movable panel system capable of being fully opened comprising:

a panel moving compartment, a panel storage space and a panel control module;

wherein the panel moving compartment comprises an upper track groove located in a top board and a lower track groove located below the panel storage space, wherein the upper track groove and the lower track groove extend in a same lengthwise direction of the panel moving compartment and are parallel to each other, panels are successively arranged and provided between the upper track groove and the lower track groove, and the panel storage space is located at an end of the panel moving compartment;

a length of the panel storage space is equal to a length of one of the panels, a width of the panel storage space is equal to a sum of a thickness of each of the panels;

each of the panels comprises a panel main body, a panel top frame located at an upper side of the panel main body, and a panel base located at a lower side of the panel main body, wherein an upper lengthwise moving track is provided in the upper track groove, an upper part of the panel top frame of each of the panels is provided with a respective upper lengthwise moving guide wheel operating on the upper lengthwise moving track in the lengthwise direction of the panel moving compartment;

a lower lengthwise moving track is provided in the lower track groove, a lower part of the panel base of each of the panels is provided with a lower lengthwise moving wheel operating on the lower lengthwise moving track, the lower lengthwise moving wheel of each of the panels comprises at least one lengthwise moving power wheel, each of the at least one lengthwise moving power wheels is driven by a respective lengthwise moving motor;

an upper widthwise moving track is provided in an upper portion of the panel storage space, the upper widthwise moving track is perpendicular to the upper lengthwise moving track, the upper widthwise moving track is provided with an upper track frame capable of sliding along the upper widthwise moving track, the upper track frame includes an upper widthwise moving power wheel which engages the upper widthwise moving track, the upper widthwise moving power wheel is driven by an upper widthwise moving motor, a lower part of the upper portion of the panel storage space is provided with an upper moving groove extending along a first portion of the panel storage space, the upper portion of the panel storage space is provided with an upper track frame storage cavity extending along a second portion of the panel storage space, a lower part of the upper track frame is provided with a plurality of upper butting tracks, each of the upper butting tracks serves as an extension in the lengthwise direction of the upper lengthwise moving track for a respective one of the panels to enable the respective one of the panels to transition from the panel moving compartment into the panel storage space, when one of the upper butting tracks is butted to the upper lengthwise moving track, the rest of the upper butting tracks are misaligned with the upper lengthwise moving track, the respective upper lengthwise moving guide wheel at the upper part of the panel top frame of each of the panels can enter a corresponding one of the upper butting tracks when the corresponding one of the upper butting tracks is butted to the upper lengthwise moving track;

a lower widthwise moving track is provided in a lower portion of the panel storage space, the lower widthwise moving track is perpendicular to the lower lengthwise moving track, the lower widthwise moving track is provided with a lower track frame capable of sliding along the lower widthwise moving track, the lower track frame includes a lower widthwise moving power wheel which engages the lower widthwise moving track, the lower widthwise moving power wheel is driven by a lower widthwise moving motor, an upper part of the lower portion of the panel storage space is provided with a lower moving groove extending along the first portion of the panel storage space, the lower portion of the panel storage space is provided with a lower track frame storage cavity extending along the second portion of the panel storage space, an upper part of the lower track frame is provided with a plurality of lower butting tracks, each of the lower butting tracks serves as an extension in the lengthwise direction of the lower lengthwise moving track for the respective one of the panels to enable the respective one of the panels to transition from the panel moving compartment into the panel storage space, when one of the lower butting tracks is butted to the lower lengthwise moving track, the rest of the lower butting tracks are misaligned with the lower lengthwise moving track, and the lower lengthwise moving wheel at the lower part of the panel base of each of the panels can enter a corresponding one of the lower butting tracks when the corresponding one of the lower butting tracks is butted to the lower lengthwise moving track.

2. The space-saving movable panel system capable of being fully opened according to claim 1, wherein a first end of the panel main body of each of the panels is hinged to the panel top frame of a respective one of the panels through a single panel rotating shaft, a second end of the panel main body of each of the panels is locked to a respective one of the panel bases through a hand-actuated bolt.

3. The space-saving movable panel system capable of being fully opened according to claim 2, wherein the second end of the panel main body of each of the panels is provided with an inwardly recessed arc-shaped groove.

4. The space-saving movable panel system capable of being fully opened according to claim 1, wherein each of the panels is provided with a chargeable power supply to supply power to a respective one of the lengthwise moving motors, and each of the panels is provided with conductor interfaces connected to a respective one of the chargeable power supplies, and when the panels are in a closed position, the conductor interfaces are electrically connected together to form a parallel charging circuit, and one of the panels includes an alternating current charging connector.

5. The space-saving movable panel system capable of being fully opened according to claim 1, wherein the upper widthwise moving motor and the lower widthwise moving motor are connected to a wired power source.

6. The space-saving movable panel system capable of being fully opened according to claim 1, wherein the upper widthwise moving motor is connected to the upper widthwise moving power wheel with a belt or chain, each of the lengthwise moving motors is connected to a respective one of the lengthwise moving power wheels with a belt or chain and the lower widthwise moving motor is connected to the lower widthwise moving power wheel with a belt or chain.

* * * * *